US007056556B2

(12) United States Patent
Burns

(10) Patent No.: US 7,056,556 B2
(45) Date of Patent: Jun. 6, 2006

(54) ADHESIVE APPLICATOR

(75) Inventor: Robert S. Burns, New Wilmington, PA (US)

(73) Assignee: Millennium Adhesive Products Incorporated, Chagrin Falls, OH (US)

( * ) Notice: Subject to any disclaimer, the term of this patent is extended or adjusted under 35 U.S.C. 154(b) by 113 days.

(21) Appl. No.: 10/763,491

(22) Filed: Jan. 23, 2004

(65) Prior Publication Data

US 2005/0160976 A1 Jul. 28, 2005

(51) Int. Cl.
*B05D 5/00* (2006.01)

(52) U.S. Cl. ..... 427/286; 427/208.6; 118/315; 118/305

(58) Field of Classification Search ..... 427/286, 427/208.6; 222/626, 608, 145.5, 145.6, 325–327; 404/93; 401/48; 118/305–307, 323, 315, 118/313

See application file for complete search history.

(56) References Cited

U.S. PATENT DOCUMENTS 3,562,808 A 2/1971 Whitley, Jr.
4,055,384 A 10/1977 Palzer
4,629,094 A 12/1986 Vogel et al.
4,831,958 A 5/1989 Selby
5,254,167 A 10/1993 Janoski et al.
5,441,583 A 8/1995 Eaton et al.
5,865,549 A 2/1999 Kinard et al.
6,062,443 A * 5/2000 Smrt ..... 222/608
6,325,256 B1 * 12/2001 Liljeqvist et al. ..... 222/402.15
6,394,166 B1 5/2002 Hubbard et al.
6,416,854 B1 7/2002 Hunter, Jr.
2003/0129011 A1 7/2003 Kugler et al.

* cited by examiner

*Primary Examiner*—Brenda A. Lamb
(74) *Attorney, Agent, or Firm*—Pearne & Gordon LLP

(57) ABSTRACT

An apparatus is provided for concurrently applying to a first substrate, such as a layer of a roofing surface, for the purpose of securing the first substrate to a second substrate placed on the first substrate, a plurality of substantially parallel strips of an adhesive. The apparatus includes a carrier having motive supports for transporting the carrier along a path of travel over the first substrate. Mounted on the carrier is a rack for holding at least one canister containing the adhesive. Also mounted on the carrier is a discharging mechanism that is adapted to discharge the adhesive from the at least one canister as a plurality of adhesive strips when a driving force is applied to the discharging mechanism. The driving force is supplied to the discharging mechanism by an actuating mechanism that is also mounted on the carrier.

88 Claims, 4 Drawing Sheets

ADHESIVE APPLICATOR

BACKGROUND OF INVENTION

The present invention relates, generally, to an apparatus for concurrently applying to a substrate a plurality of substantially parallel strips of an adhesive discharged from a plurality of discharging units transported over the substrate by the apparatus. In particular, the adhesive applicator of the invention can be employed with an adhesive that is the reaction product of two adhesive reactants that are mixed and reacted as the adhesive is applied to the substrate.

There are a number of circumstances where an apparatus for concurrently applying a plurality of strips of an adhesive can be advantageously employed. For example, the construction of roofs for commercial and industrial buildings, typically, involves, as a first step, installing a corrugated steel decking having alternating peaks, or ribs, and valleys, or flutes. Thereafter, one or more layers of an insulating material are placed over the decking. Finally, one or more layers of a waterproof covering are placed over the insulating material. Conventionally, adhesives are used to secure the steel decking and the various layers of roofing materials together to form a, more-or-less, unitary covering for the roof. Such roofs, usually, are quite large, encompassing many square feet and, in some instances, the roofs cover several acres. Taking into account the sizes of the roofs that can be involved and the fact that several layers of roofing materials, typically, are applied, it is highly desirable that an apparatus be available that can rapidly apply large volumes of the adhesive to a relatively wide section of a roof in a single pass of the apparatus over the roofing materials.

It is important, of course that the adhesive used establish a sound bond between the layers of roofing materials to which it is applied. In this regard, it has been found that two-part, or two-component, adhesives are effective in establishing a good bond between layers of the roofing materials. These types of adhesives are the reaction products of two adhesive reactants that are mixed and react to form the two-part adhesives. In most cases, the two adhesive reactants cannot be mixed and reacted until the adhesives are applied to the roofing materials because the adhesives cure and set-up quite rapidly after the adhesive reactants are mixed. Consequently, any apparatus used to apply a two-part adhesive, preferably, has the ability to mix the two adhesive reactants forming the adhesive as the adhesive is applied to the roofing materials.

BRIEF SUMMARY OF INVENTION

Much of the description and discussion herein relating to the adhesive applicator of the present invention is presented with reference to the use of the invention in connection with the construction of roofs of buildings, particularly where a corrugated steel decking is employed. However, the invention has application, generally, where it is desired to concurrently apply to any type of substrate a plurality of substantially parallel strips of an adhesive, including instances where the adhesive used is the reaction product of two adhesive reactants that are mixed and reacted as the adhesive is applied.

According to one aspect, the invention comprises an apparatus for concurrently applying to a substrate a plurality of substantially parallel strips of an adhesive. The apparatus includes a carrier with motive supports for transporting the carrier along a path of travel over the substrate. A plurality of cradles are mounted on the carrier and are arranged in a line transversely of the path of travel of the carrier over the substrate. Each cradle is adapted to hold a canister of the adhesive. A discharging mechanism is mounted on the carrier and is adapted, when a driving force is applied, to concurrently discharge the adhesive from the plurality of canisters in the cradles. Also mounted on the carrier is an actuating mechanism for selectively providing a driving force to the discharging mechanism. The discharging mechanism may include at least one plunger located at each cradle that is adapted to fit within the canister of adhesive held in the cradle. Each plunger is connected to the actuating mechanism for displacement within a respective canister so as to discharge the adhesive from the canister concurrently with the discharge of the adhesive from the other canisters upon the actuating mechanism selectively providing a driving force to the discharging mechanism.

According to another aspect, the discharging mechanism includes a pair of plungers located at each cradle. Each pair of plungers is adapted to fit within a complementary pair of segregated compartments that contain adhesive reactants within the canister. The pair of plungers at each cradle is connected to the actuating mechanism for displacement within the pair of segregated compartments in the canister upon the actuating mechanism selectively providing a driving force to the discharging mechanism, including the plungers. The activation of the discharging mechanism results in the discharge of the adhesive reactants from the pair of segregated compartments into a mixing nozzle associated with the canister and from which an adhesive, produced by the mixing and reaction of the two adhesive reactants in the mixing nozzle, is discharged concurrently with the discharge of the adhesive from the other canisters.

According to yet another aspect, the discharging mechanism includes a single pressure bar that is connected to the plungers and to the actuating mechanism for concurrently displacing the plungers within the adhesive canisters and discharging the adhesive upon the actuating mechanism selectively providing a driving force to the discharging mechanism, including the pressure bar.

According to a further aspect, the actuating mechanism includes a telescoping member having opposed ends and a driving device for developing a driving force. One of the opposed ends of the telescoping member is attached to the driving device whereby the driving force acts to extend the telescoping member. The other end of the telescoping member is attached to the pressure bar of the discharging mechanism for transmitting to the discharging mechanism the driving force developed by the driving device, thereby discharging the adhesive from the plurality of canisters.

According to another aspect, a force-resisting device provides a resisting force to the driving force selectively provided by the actuating mechanism to the discharging mechanism. The magnitude of the resisting force of the force-resisting device is less than the magnitude of the driving force. There also may be provided a release mechanism for releasing the driving force provided by the actuating mechanism to allow the resisting force provided by the force-resisting device to disengage the plungers from the canisters.

According to yet another aspect, the motive supports of the apparatus are configured so that the apparatus can be efficiently employed on a corrugated steel decking having ribs, or peaks, and flutes, or valleys. Specifically, the motive supports include a pair of wheels located at the rearward end of the carrier. Each wheel of the pair of wheels is no wider than the flutes of the corrugated steel decking and the wheels are spaced apart a distance such that, when the apparatus is positioned on the corrugated decking, the wheels straddle a rib and rest in two adjacent flutes of the decking. If desired, a single wheel, rather than a pair of wheels, can be mounted at the rearward end of the carrier in which case the single wheel will rest in a flute when the apparatus is used. The motive supports also include two coaxial wheels located at the forward end of the carrier outwardly of the wheel or pair of wheels located at the rearward end of the carrier. The two wheels at the forward end of the carrier, typically, are wider than the flutes in the corrugated steel decking on which the apparatus is employed and, consequently, will rest on the ribs of the decking.

According to still another aspect, a gauge is provided for indicating the location in the canisters of the plungers of the discharging mechanism. As a result, the operator is able to determine whether the apparatus is operating and the amount of adhesive in the canisters at any time.

According to yet a further aspect, the plurality of cradles, the discharging mechanism and the actuating mechanism are mounted on the carrier, essentially, in a common plane at an angle of about 30 degrees between that common plane and the substrate to which the adhesive is applied.

According to still another aspect, an apparatus is provided for concurrently applying to a substrate a plurality of parallel strips of an adhesive, the apparatus including a carrier having a forward end and a rearward end. The apparatus also includes a base and wheels rotatably mounted to the base for transporting the apparatus over the substrate along a path of travel with the forward end leading the rearward end. A mounting structure is attached to the base, and a rack of cradles is attached to the mounting structure. The rack of cradles is arranged on the mounting structure in a line transversely of the path of travel of the apparatus, each of the cradles in the rack of cradles being adapted to hold a canister of the adhesive. A pressure bar is mounted so as to be movable toward and away from the rack of cradles. The pressure bar is located toward the forward end of the carrier in relation to the rack of cradles and extends substantially parallel to and is located essentially in the same plane as the rack of cradles. Attached to the pressure bar is a series of plungers. Each plunger has a plunger rod with opposed ends and a plunger head. One of the opposed ends of each plunger rod is secured to the pressure bar so that the plunger rod extends substantially perpendicularly from the pressure bar toward the rack of cradles. The other of the opposed ends of each plunger rod is attached to a plunger head. The plungers are of sufficient length and are arranged on the pressure bar so that the plunger head of at least one plunger is positioned within each cradle in the rack of cradles for displacing an adhesive from the canister in each cradle. An actuating mechanism is mounted on the mounting structure for selectively forcing the pressure bar, together with the plungers, toward the adhesive canisters in the rack of cradles whereby the plungers concurrently displace adhesive from the canisters.

According to a further aspect, an apparatus for concurrently applying to a substrate a plurality of substantially parallel strips of an adhesive comprises a carrier having motive supports for transporting the carrier along a path of travel over the substrate and a rack mounted on the carrier for holding one or more canisters of the adhesive. Also mounted on the carrier for selectively developing a driving force is an actuating mechanism. At least one respective plunger, adapted to fit within each of the one or more canisters, is connected to the actuating mechanism for displacement of the at least one respective plunger within each canister upon the application of the driving force from the actuating mechanism to the at least one respective plunger. As a result, the adhesive is displaced from the one or more canisters to the substrate as a plurality of substantially parallel strips of the adhesive.

According to another aspect, a single pressure bar is connected to both the at least one plunger and the actuating mechanism whereby the driving force developed by the actuating mechanism is applied to the pressure bar and, from the pressure bar, to the at least one plunger.

According to still another aspect, at least two plungers adapted to fit within each of the one or more canisters and displace adhesive reactants from the one or more canisters are connected to an actuating mechanism for displacing the at least two plungers within each of the one or more canisters. The adhesive reactants from the one or more canisters are thereby displaced from the one or more canisters and mixed, and the adhesive produced by the mixing of the adhesive reactants is discharged to the substrate as a plurality of substantially parallel strips of the adhesive.

BRIEF DESCRIPTION OF THE DRAWINGS

Referring now to the drawings wherein like elements are numbered the same in the various figures.

DETAILED DESCRIPTION OF THE INVENTION

Figure 1:
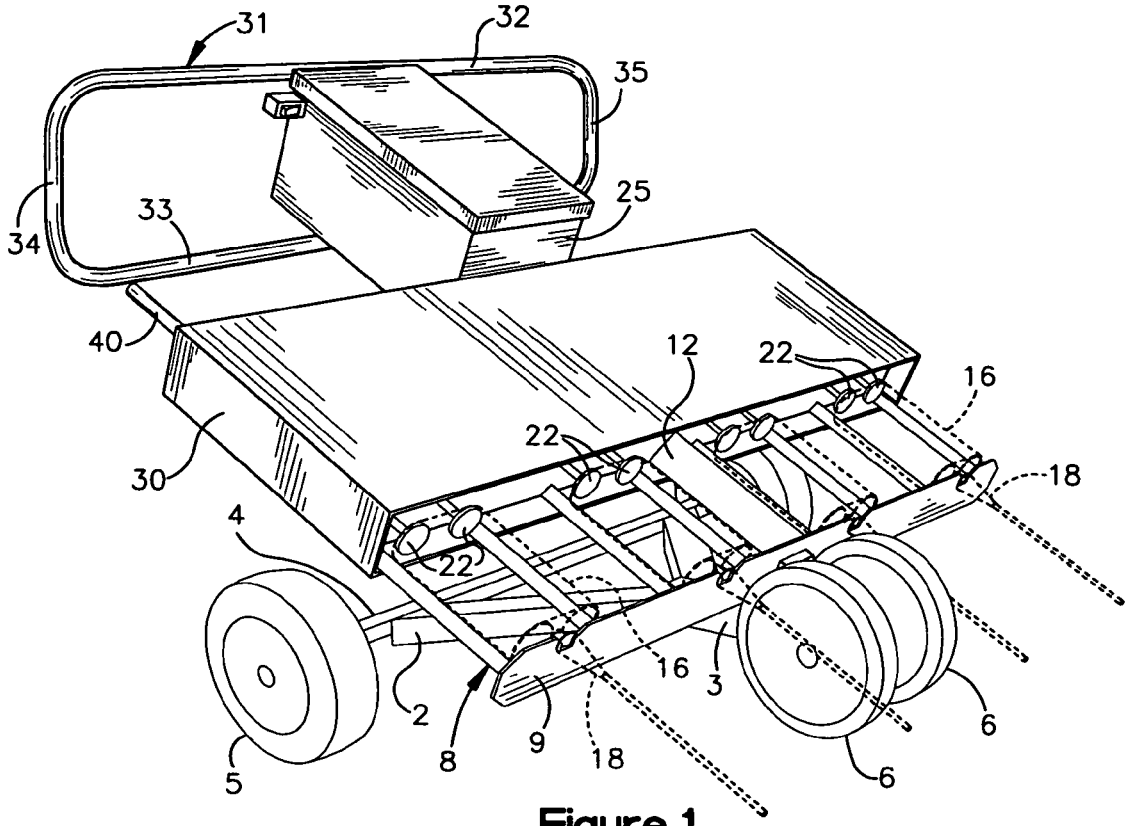
FIG. 1 is a perspective view of an embodiment of the apparatus of the invention in which the canisters of an adhesive to be applied to a substrate are shown by the use of dashed lines.

The embodiment of the invention illustrated in the drawings comprises an apparatus for concurrently applying to a substrate, such as a roof decking, a plurality of substantially parallel strips of a two-part adhesive.

Figure 2:
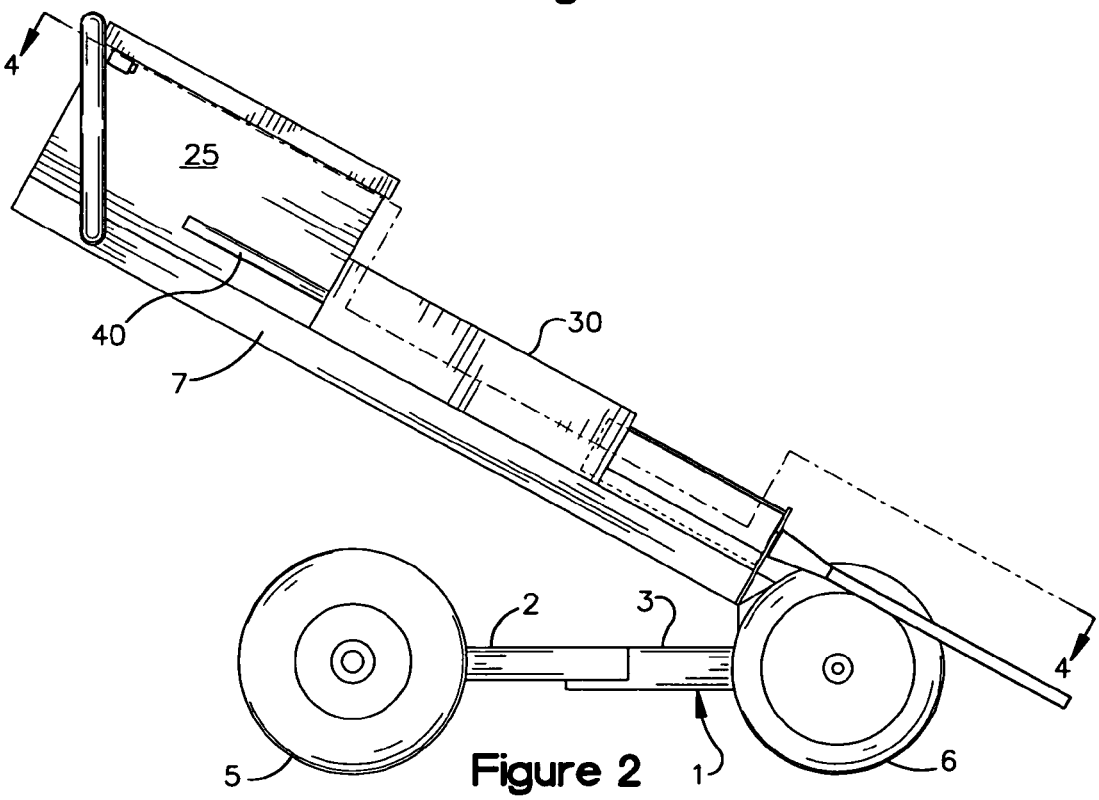
FIG. 2 is a side elevational view of the apparatus shown in FIG. 1.

The adhesive applicator shown in the drawings includes a carrier upon which the other components of the applicator, further described below, are mounted. The carrier includes a base which, although it may take various forms, as will be appreciated by those skilled in the art, is shown generally in the drawings at 1 as having a Y-shape. The base is fabricated from sections of structural steel and has a pair of lateral sections 2, each welded at substantially the same angle to a depending section 3. A cross-piece 4 is attached to the free ends of the lateral sections 2, and the cross-piece is provided with spindles at each of its ends on which rubber-tired wheels 5 are rotatably mounted. The depending section 3 also is provided with a spindle at its free end on which a pair of wheels 6 are rotatably mounted. In operation, the applicator, as illustrated in FIG. 2, follows a path of travel from the right to the left and the wheels 6, located at the rearward end of the carrier, and 5, located at the forward end of the carrier, provide motive supports for transporting the carrier and the components of the adhesive applicator mounted on the carrier over the substrate onto which the adhesive is to be applied.

Although the particular spacing and arrangement of the wheels on the carrier is, largely, a matter of choice, the spacing and arrangement shown in the drawings enables the carrier to easily traverse a corrugated steel decking in a roofing system. Corrugated steel deckings are fabricated so as to have alternating ribs, or peaks, and flutes, or valleys. Accordingly, the embodiment of the adhesive applicator shown in the drawings is constructed so that the pair of rubber-tired wheels 6 are located coaxially at the rearward end of the carrier and are spaced apart a distance such that the wheels straddle a rib in the corrugated decking and rest at the bottom of adjacent valleys in the decking. Additionally, the wheels are of a width such that they will easily fit within the flutes. The two rubber-tired wheels 5 are located coaxially at the forward end of the carrier outwardly of the wheels 6 at the rearward end of the carrier. The width of each wheel 5 is greater than the width of the flutes in the corrugated decking and, consequently, the wheels 5 rest at the tops of the ribs of the decking when the applicator is traversing the decking with the forward end of the carrier leading the rearward end. With this arrangement of the wheels, the wheels 6 serve to keep the applicator on a straight course as the corrugated steel decking is traversed and the adhesive applied. In order to accommodate corrugated steel decking having ribs of various widths, spacers 42 are provided for the purpose of adjusting the spacing between wheels 6.

The carrier also includes a mounting structure on which is mounted the other components of the adhesive applicator. In the embodiment of the invention shown in the drawings, the mounting structure comprises a structural steel section 7 that is attached to the Y-shaped base 1 of the carrier near the free end of the depending section 3 by, for example, welding the section 7 to the base. The structural steel section 7 is mounted at an angle of less than 90 degrees, and, preferably, at an angle of about 30 degrees, upwardly from the rearward end of the carrier toward the forward end of the carrier. Of course, the mounting structure can take other forms for the purpose of supporting the other components of the applicator, as would be apparent to those of ordinary skill in the art familiar with the descriptions set forth herein.

Mounted to the carrier is a rack of a plurality of cradles shown generally at 8. The rack of cradles extends, generally, transversely to the path of travel of the carrier over the substrate to which the adhesive is to be applied. The rack of cradles comprises: two support members, a resting plate 9 and a channel member 10, that are attached to the mounting structure 7 parallel to one another and spaced apart a preselected distance and that extend across the carrier in a direction transversely of the path of travel of the apparatus; and a series of cradle-forming members, or cradle bars, 11. The channel member 10 has two flanges 13 and 14 that are joined by top plate 15. The cradle bars 11 have opposed ends. One of the ends of each of the cradle bars is attached to flange 13 of channel member 10 and the other of the opposed ends of each of the cradle bars is attached to the resting plate 9. The cradle bars are positioned on the resting plate 9 and the channel member 10 so as to be substantially parallel to each other and perpendicular to the resting plate and the channel member. Additionally, the cradle bars 11 are positioned and arranged so as to provide a plurality of pairs of cradle bars, the bars in each pair of cradle bars being spaced apart a distance such that they will hold a canister of the adhesive 16 as shown by the dashed lines in FIGS. 1 and 3.

Figure 5:
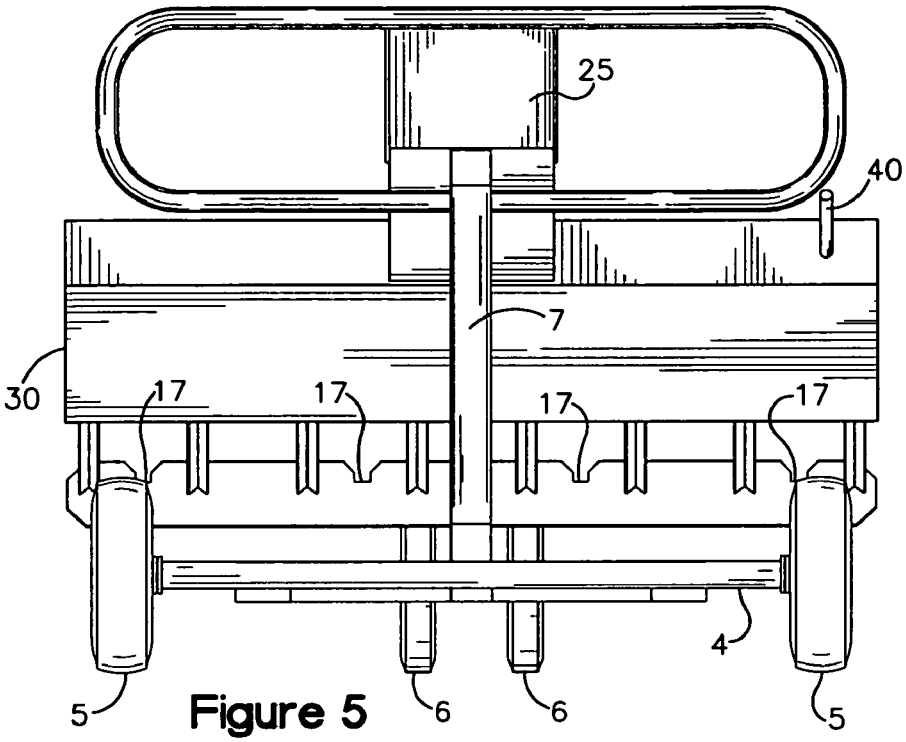
FIG. 5 is a rear elevational view of the apparatus shown in FIG. 1.
Figure 6:
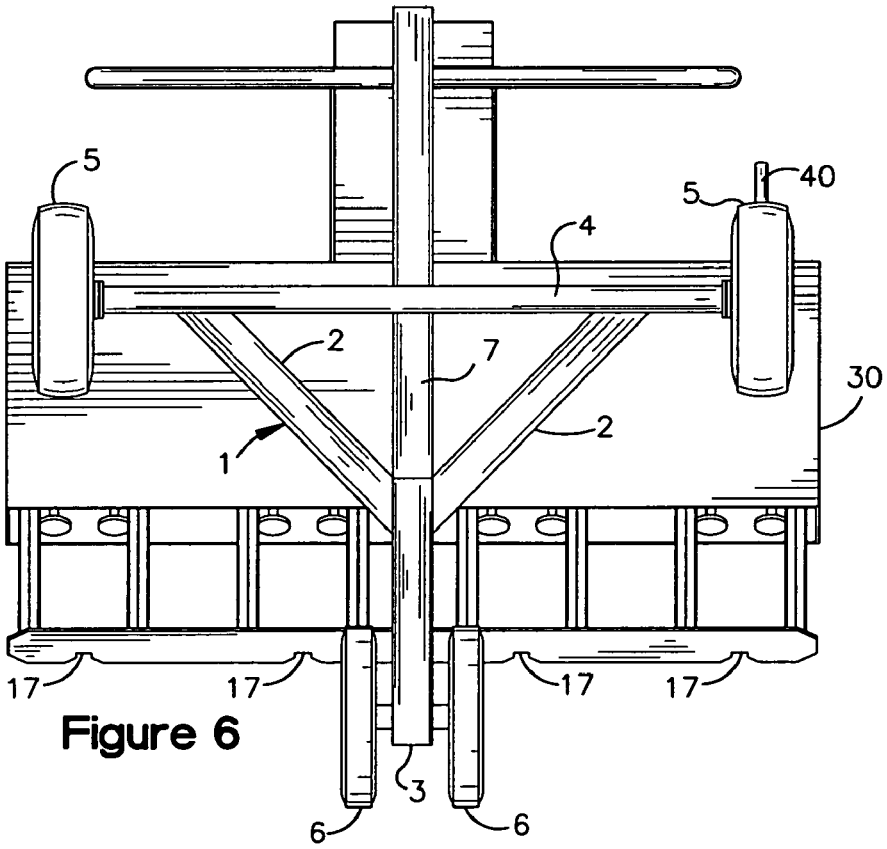
FIG. 6 is a bottom view of the apparatus shown in FIG. 1.

Notches 17 are provided in the top edge of resting plate 9 at locations substantially equidistant between the points where the cradle bars of each pair of cradle bars is attached to resting plate 9 as best shown in FIGS. 5 and 6. As a result, each pair of the cradle-forming members 11, together with the sections of the support members between the pair of cradle-forming members, including the notch 17 in the resting plate, form a cradle in the rack of cradles for carrying an adhesive canister 16. In the adhesive applicator shown in the drawings, the rack of cradles 8 includes four such cradles for carrying four canisters of the adhesive although any desired number of cradles can be provided. Each adhesive canister includes a mixing and dispensing nozzle 18, the function of which is described below.

The rack of cradles is mounted to the carrier 1 by welding the resting plate 9 and the channel member 10 of the rack to the structural steel member 7. As shown in the drawings, the rack of cradles is mounted to the carrier so that the cradles are spaced from one another on the rack transversely of the path of travel of the carrier over the substrate to which the adhesive is to be applied.

The spacing between adjacent cradles is coordinated with the spacing of the ribs in the corrugated roof decking to which the adhesive is to be applied so that the mixing and dispensing nozzle 18 of each adhesive canister 16 will be disposed at a rib in the roof decking. By way of example, a standard roof decking has ribs spaced on centers every 6 inches. In that case, the notches in the resting plate 9 are spaced apart by 12 inches so that the nozzles 18 of the canisters 16 will be located above every second rib in the roof decking.

Figure 3:
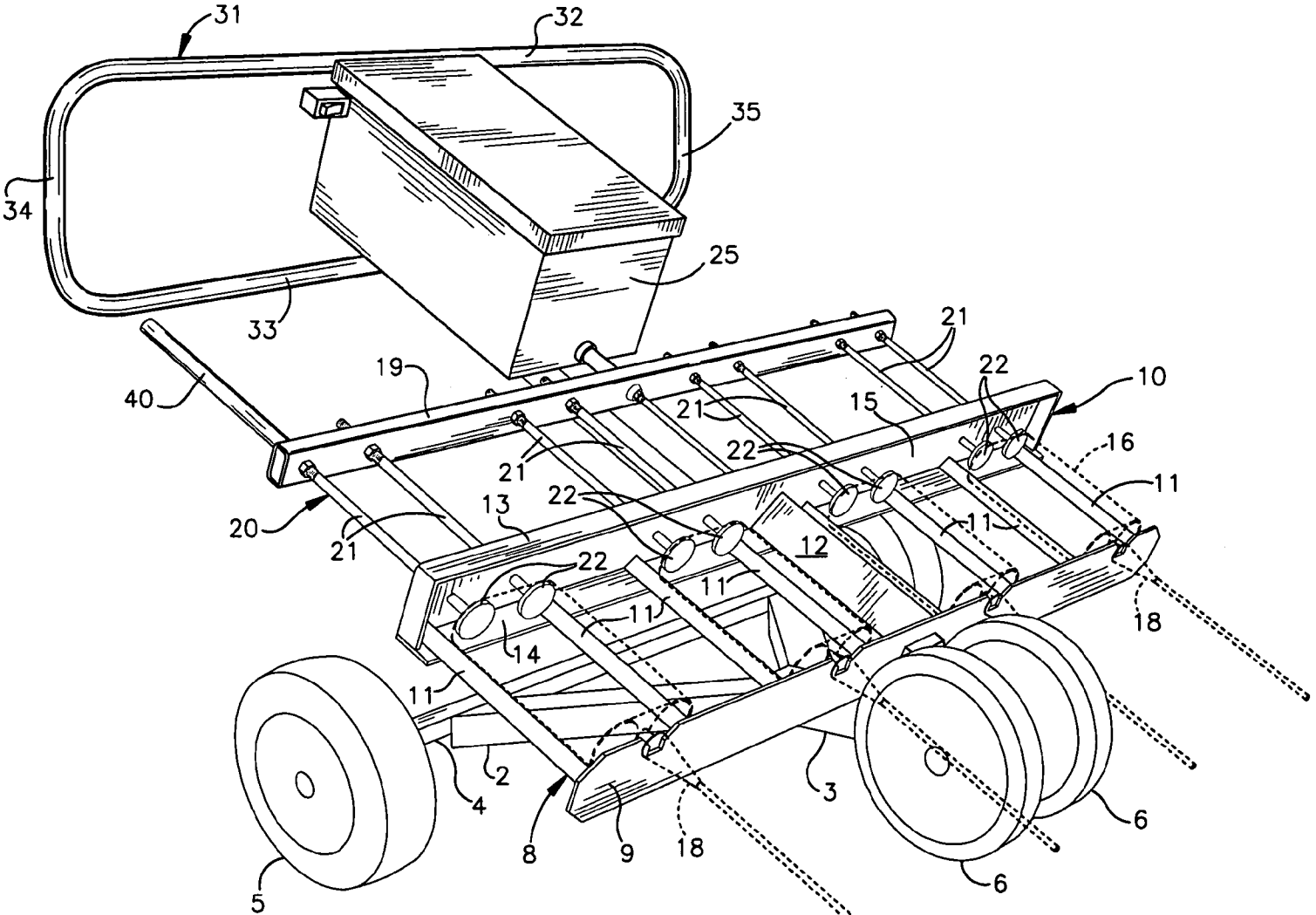
FIG. 3 is a perspective view of the apparatus of the invention with the cover removed from a section of the apparatus for the purpose of better illustrating certain internal components.
Figure 4:
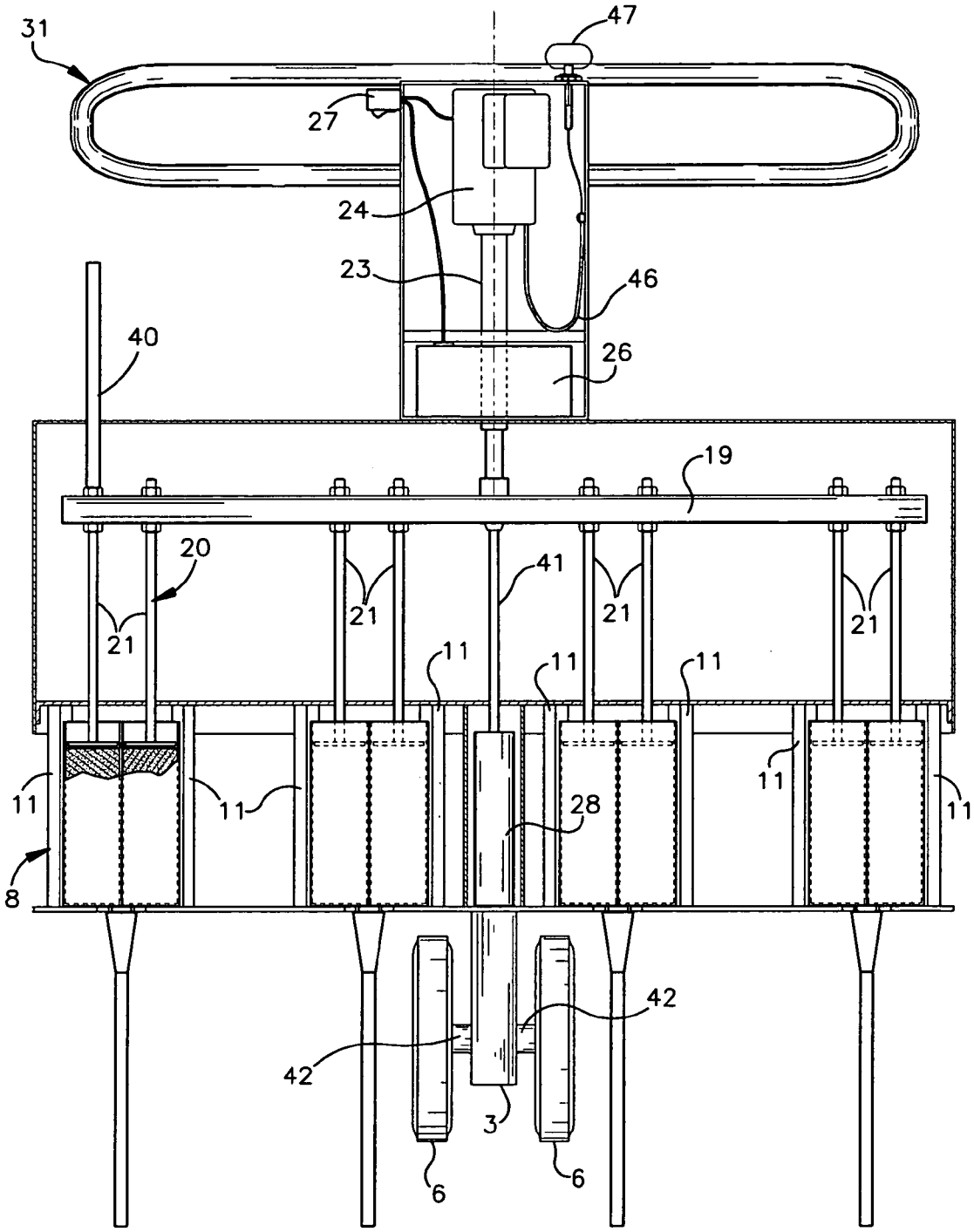
FIG. 4 is a sectional top view of the apparatus taken along the lines 4—4 of FIG. 1.

Also mounted to the carrier 1 is a discharging mechanism that is adapted, when activated, to discharge or displace the adhesive from the canisters 16. The discharging mechanism includes a pressure bar 19, as shown in FIGS. 3 and 4, that, essentially, is held in place above structural steel section 7 by means of the pressure bar's connections to telescoping member 23 and gas spring 28, as is further described below, so as to be movably mounted on structural steel section 7. The pressure bar extends transversely of the path of travel of the carrier in substantially the same manner as, and parallel to, the rack 8. Additionally, the pressure bar is located in, essentially, the same plane as the rack of cradles for reasons that will be apparent from the description below.

The discharging mechanism also includes a series of plungers of substantially equal length, indicated generally at 20, as shown in FIGS. 3 and 4. Each plunger includes a plunger rod 21, having opposed ends, and a plunger head 22. Both of the opposed ends of each plunger rod are threaded. One threaded end is secured to the pressure bar by means of complementary nuts and the other threaded end of each plunger rod has threaded to it a disk-shaped plunger head 22. Each plunger rod 21 extends perpendicularly away from the pressure bar through an opening in the top plate 15 of channel member 10. The piston rods are of a length such that their plunger heads are located within respective cradles in the rack of cradles 8.

The plungers are positioned on the pressure bar so as to be arranged in pairs of plungers, and there are the same number of pairs of plungers as cradles. The pairs of plungers are positioned along the pressure bar 19 so that the plungers of each pair of plungers are contained within a respective cradle and fit snugly within segregated cylindrical compartments in the canisters 16. A pair of plungers is employed with the canister in each cradle in order to effectively discharge both adhesive reactants of the two-part adhesive that is employed with the adhesive applicator shown in the figures. It is preferred for a variety of applications to employ an adhesive that is the reaction product of two adhesive reactants such as a diisocyanate and a polyol mixture. The reactants must be separated until the adhesive is applied to the substrate because the adhesive formed when the reactants are mixed together will cure and set up soon after the reactants are mixed. This separation is accomplished in the present invention by packaging the adhesive reactants in segregated compartments in the canisters 16. At the time the adhesive is to be applied, the adhesive reactants are displaced from their respective compartments into nozzles 18 by the plungers 20 where the reactants mix and react to form an adhesive that is then discharged from the nozzles to the substrate. Although it is presently preferred to use the applicator with two-part adhesives, in which case two plungers are required for each adhesive canister, it will be apparent to one of ordinary skill in the art that the applicator of the invention can be modified for use with single-component adhesives.

The applicator of the invention also includes an actuating mechanism mounted on the carrier for activating the discharging mechanism. The actuating mechanism includes a telescoping member 23 that is attached at one end to the pressure bar 19 at substantially the midpoint of the pressure bar. The other end of the telescoping member is attached to a driving device 24, such as an electric motor, for example, for developing a driving force. The driving device 24 is located within a metal box 25 that is mounted on structural steel section 7. The electric motor, when energized, extends the telescoping member 23, forcing the pressure bar 19 toward cradle rack 8 and driving the plungers 22 through the segregated compartments of the canisters 16, thereby displacing the adhesive reactants from the compartments into the nozzles 18 where the reactants mix and react to form the adhesive that is then discharged and applied to the substrate. The telescoping member is located in the same plane as the pressure bar, the plungers and the canisters so that the driving force developed by the driving device will cause the plungers to be suitably displaced within the compartments of the canisters. Of course, it is not necessary that a telescoping member and an electric motor be used as the actuating mechanism to force the pressure bar toward the rack of cradles and any suitable mechanism can be used. For example, an air compressor can be used in place of the electric motor and a rack and pinion gearing arrangement can be used in place of the telescoping member. Other mechanisms for delivering a driving force to the pressure bar also can be used as will be apparent to one of ordinary skill in the art based on the disclosures contained herein.

The energy source for operating the motor 24 is a battery 26 also located in the metal box 25. A trigger switch 27 is mounted on the outside of the metal box 25 and is electrically interposed between the battery and the motor 24 so as to control the delivery of electric energy to the motor and selectively energize the motor and activate the discharging mechanism.

One end of a force-resisting device, such as a gas spring in the nature of a shock absorber 28, is mounted to the resting plate 9 underneath cover 12. The other end of the gas spring is fixed to one end of a rod 41. The other end of the rod 41 is secured to the pressure bar 19 in line with the telescoping number 23. The length of the gas spring 28 is such that when it is in its fully extended position the plunger heads 22 in the cradles will be located at the tops of the compartments in the canisters 16, as shown in FIGS. 1, 3 and 4 and will not be exerting a displacing force within the compartments. When the applicator is in operation, the movement of the pressure bar toward the rack of cradles 8 and the accompanying displacement of the plunger heads 22 within the segregated compartments of the adhesive canisters 16 will be resisted by the gas spring 28, but the magnitude of the resisting force is less than the driving force generated by the driving device 24 through the telescoping member 23 and the pressure bar 19. Consequently, the driving force will overcome the resisting force of the force-resisting device 28 whereby the plunger heads 22 will be driven through the canisters and the adhesive discharged to the substrate.

A release mechanism including a wire cable 46 is attached at one end to a pull 47 located on the exterior of the metal box 25. The other end of the wire cable 46 is attached to the interconnection between the telescoping member 23 and the motor 24. When it is desired to withdraw the plungers from the containers, such as when all the adhesive has been discharged, the trigger switch 27 is first released. The pull 47 is then pulled and the force on the telescoping member generated by the driving device 24 is released. In the described embodiment, where a gearing arrangement is employed to convert the circular motion generated by the motor 24 to longitudinal motion to extend the telescoping member 23, the release mechanism will disengage the gearing arrangement in a manner understood by those skilled in the art. As a result, the energy stored in the gas spring 28, as it was compressed by the pressure bar moving toward the rack of cradles 8, will be released and the gas spring will force the pressure bar away from the rack causing the plunger heads 22 to be moved upwardly within the segregated compartments in the canisters 16. As will be understood by those having ordinary skill in the art, means other than a gas spring can be used as the force-resisting device 28. By way of example, a conventional compression spring can be advantageously employed.

In order to provide a degree of protection to the components of the applicator, the rack, with its cradles, the pressure bar, with its dependent plungers, and the gas spring are all encased in a rectangular-shaped box-like housing 30. The telescoping member 23 extends through an opening in the top of the housing 30 and into the metal box 25 through an opening in the bottom of the metal box.

For the purpose of maneuvering the applicator, a rectangular-shaped handle 31 is provided at the forward end of the applicator. The handle has an upper horizontal bar 32 and a lower horizontal bar 33 that is, substantially, of equal length and parallel to the upper horizontal bar. The horizontal bars are joined at their respective ends by vertical bars 34 and 35. The handle is fastened to the carrier by the attachment of the lower horizontal bar at substantially its midpoint to the structural section 7.

Because it is advantageous to be aware of the extent to which the plungers have moved through the segregated compartments of the canisters as the adhesive is being applied to the substrate, a displacement gauge in the form of a rod 40 is provided. One end of the gauge is fixed to the pressure bar 19 and the other end of the gauge extends through the top of the housing 30. Appropriate indicia are applied to the gauge to indicate the location of the plungers in the canisters and the extent to which the pressure bar has moved. As a result, the operator will be provided with an indication of the amount of adhesive remaining in the canisters. Additionally, because the work area can be very noisy, the operator may not be able to hear the motor when it is running and the gauge will allow the operator to confirm that adhesive is being discharged.

When the applicator is to be loaded with the adhesive canisters, the gas spring will have moved the pressure bar away from the rack of cradles 8 which will result in the pairs of plungers 20 being moved to the tops of their respective cradles. The canisters 16 are placed in the cradles of the rack 8 and the plunger heads 22 are inserted within respective segregated compartments in the canisters. The segregated compartments are provided with closure caps that engage the plunger heads 22. The closure caps fit very tightly to the walls of the compartments but are slidable within the compartments. With the adhesive loaded in the cradles and the plungers disposed within respective segregated compartments in the canisters, the applicator can be placed into operation.

In operation on a corrugated steel decking, the applicator is positioned on the decking so that the two wheels 6 straddle a rib in the decking and rest at the bottoms of two adjacent flutes in the decking and the two wheels 5 rest at the tops of the decking ribs. At the same time, the nozzle 18 of each canister 16 will be disposed slightly above a rib onto which it is desired to apply a strip of adhesive. Operation of the applicator is selectively performed by the operator engaging the trigger switch 27 and pulling the applicator in a forward direction using the handle 31. Upon the engagement of the trigger switch by the operator, the driving device 24 will develop a driving force that will extend the telescoping member 23, forcing the pressure bar 19 towards the rack of cradles 8. In turn, the plungers 20, attached to the pressure bar 19, will force the closure caps in the segregated compartments of the canisters 16 through the compartments, thereby displacing the adhesive reactants from the segregated compartments into the nozzles 18 of the canisters. The adhesive reactants will mix and react inside the nozzles and the reaction product, an adhesive, will be discharged from the nozzles onto the substrate. The speed at which the operator moves the applicator over the decking will determine the thickness of the strips of adhesive that are applied.

In order to provide for the efficient delivery of the driving force to the adhesive in the canisters, the cradles holding the canisters, the discharging mechanism in the form of the plungers 20 and the pressure bar 19, and the telescoping member 23 of the actuating mechanism are all aligned in a common plane at about 30 degrees to the substrate to which the adhesive is to be applied. In other words, a common plane located at about 30 degrees to the substrate and extending from the motor 24 to the nozzles 18 of the canisters divides the telescoping member 23, the pressure bar 19, the plungers 20 and the canisters 16 in the cradles into, substantially, equal halves. As a result, the driving force developed by the extension of the telescoping member 23 is delivered in-line to the pressure bars and plungers and the pressure bar and plungers deliver the driving force in-line to the adhesive in the canisters.

The foregoing description of a particular embodiment of the invention discloses the use of the same number of adhesive canisters as strips of adhesive to be applied to the substrate. However, alternative arrangements can be employed. Thus, there can be provided at least one respective plunger for each of one or more canisters. The at least one respective plunger is connected to the actuating mechanism for displacement within each canister upon the application of a driving force from the actuating mechanism, whereby the adhesive from the one or more canisters is displaced to the substrate as a plurality of substantially parallel strips of the adhesive. As an example of the foregoing, where a two-component adhesive is to be applied, one of the components, or reactants, can be contained within a first canister and the other of the components, or reactants, can be contained within a second container. The reactants can be displaced from the first and second canisters using a pressure bar and plungers, generally, in the manner described above. The displaced reactants can be directed through suitable conduits to a mixing device on the carrier where the reactants mix and react to from the adhesive. The adhesive can then be directed through a plurality of suitable conduits on the carrier and a plurality of substantially parallel strips of the adhesive concurrently applied to the substrate. Alternatively, the reactants can be directed separately from the canisters through conduits on the carrier to a plurality of mixing devices and the resulting adhesive formed at each mixing device concurrently applied to the substrate.

Various other modifications to the apparatus as described above may be made, as will be apparent to those of ordinary skill in the art, without departing from the scope of the invention as defined in the following claims.

What is claimed is:

1. An apparatus for concurrently applying to a substrate a plurality of substantially parallel strips of an adhesive, the apparatus comprising:

a carrier having motive supports for transporting the carrier along a path of travel over the substrate;

a plurality of cradles mounted to the carrier and arranged in a line transversely of the path of travel of the carrier over the substrate, each cradle being adapted to hold a canister from which adhesive is discharged;

a discharging mechanism mounted on the carrier and adapted, when a driving force is applied, to concurrently discharge the adhesive from the plurality of canisters in the cradles; and an actuating mechanism mounted on the carrier for selectively providing the driving force to the discharging mechanism, wherein the discharging mechanism includes at least one plunger located at each cradle that is adapted to fit within the canister of adhesive held in the cradle, each plunger being connected to the actuating mechanism for displacement within a respective canister so as to discharge the adhesive concurrently with the discharge of the adhesive from the other canisters upon the actuating mechanism selectively providing the driving force to the discharging mechanism.

2. The apparatus of claim 1 wherein the discharging mechanism further includes a single pressure bar that is connected to each plunger and to the actuating mechanism for concurrently displacing the plungers within respective canisters upon the actuating mechanism selectively providing a driving force to the discharging mechanism, including the pressure bar.

3. A method of concurrently applying to a substrate a plurality of substantially parallel strips of an adhesive comprising:

placing a canister of an adhesive in each of at least two of the cradles of the apparatus set forth in claim 1;

disposing the discharging mechanism into engagement with the canisters in the cradles in a manner adapted to discharge the adhesive from the canisters; and applying the driving force to the discharging mechanism to cause the discharging mechanism to concurrently discharge the adhesive from each of the canisters as the apparatus is transported along the path of travel over the substrate.

4. An apparatus for concurrently applying to a substrate a plurality of substantially parallel strips of an adhesive, the apparatus comprising:

a carrier having motive supports for transporting the carrier along a path of travel over the substrate;

a plurality of cradles mounted to the carrier and arranged in a line transversely of the path of travel of the carrier over the substrate, each cradle being adapted to hold a canister from which adhesive is discharged;

a discharging mechanism mounted on the carrier and adapted, when a driving force is applied, to concurrently discharge the adhesive from the plurality of canisters in the cradles; and an actuating mechanism mounted on the carrier for selectively providing the driving force to the discharging mechanism, wherein the discharging mechanism includes a pair of plungers located at each cradle, the pairs of plungers at each cradle being adapted to fit within a complementary pair of segregated compartments that contain adhesive reactants within the canister held in the cradle and being connected to the actuating mechanism for displacement within the pair of segregated compartments in the canister upon the actuating mechanism selectively providing the driving force to the discharging mechanism, including the plungers, whereby the adhesive reactants from the pair of segregated compartments are displaced into a mixing nozzle associated with the canister from which an adhesive produced by the mixing of the two adhesive reactants in the mixing nozzle is discharged concurrently with the discharge of the adhesive from the other canisters.

5. The apparatus of claim 4 wherein the discharging mechanism further includes a single pressure bar that is connected to each pair of plungers and to the actuating mechanism for concurrently displacing the pairs of plungers within pairs of segregated compartments of respective canisters upon the actuating mechanism selectively providing a driving force to the discharging mechanism, including the pressure bar.

6. A method of concurrently applying to a substrate a plurality of substantially parallel strips of an adhesive comprising:

placing a canister of an adhesive in each of at least two of the cradles of the apparatus set forth in claim 4;

disposing the discharging mechanism into engagement with the canisters in the cradles in a manner adapted to discharge the adhesive from the canisters; and applying the driving force to the discharging mechanism to cause the discharging mechanism to concurrently discharge the adhesive from each of the canisters as the apparatus is transported along the path of travel over the substrate.

7. An apparatus for concurrently applying to a substrate a plurality of substantially parallel strips of an adhesive, the apparatus comprising:

a carrier having motive supports for transporting the carrier along a path of travel over the substrate;

a plurality of cradles mounted to the carrier and arranged in a line transversely of the path of travel of the carrier over the substrate, each cradle being adapted to hold a canister from which adhesive is discharged;

a discharging mechanism mounted on the carrier and adapted, when a driving force is applied, to concurrently discharge the adhesive from the plurality of canisters in the cradles; and an actuating mechanism mounted on the carrier for selectively providing a driving force to the discharging mechanism, wherein the actuating mechanism includes a telescoping member having opposed ends and the driving device for developing a driving force, one of the opposed ends of the telescoping member being attached to the driving device, whereby the driving force acts to extend the telescoping member, and the other of the opposed ends of the telescoping member being attached to the discharging mechanism for transmitting to the discharging mechanism the driving force developed by the driving device.

8. The apparatus of claim 7 wherein the discharging mechanism includes at least one plunger located at each cradle that is adapted to fit within the canister of adhesive held in the cradle, each plunger being connected to the actuating mechanism for displacement within a respective canister so as to discharge the adhesive concurrently with the discharge of the adhesive from the other canisters upon the actuating mechanism selectively providing a driving force to the discharging mechanism.

9. The apparatus of claim 8 wherein the discharging mechanism further includes a single pressure bar that is connected to each plunger and to the actuating mechanism for concurrently displacing the plungers within respective canisters upon the actuating mechanism selectively providing a driving force to the discharging mechanism, including the pressure bar.

10. The apparatus of claim 7 wherein the discharging mechanism includes a pair of plungers located at each cradle, the pairs of plungers at each cradle being adapted to fit within a complementary pair of segregated compartments that contain adhesive reactants within the canister held in the cradle and being connected to the actuating mechanism for displacement within the pair of segregated compartments in the canister upon the actuating mechanism selectively providing a driving force to the discharging mechanism, including the plungers, whereby the adhesive reactants from the pair of segregated compartments are displaced into a mixing nozzle associated with the canister from which an adhesive produced by the mixing of the two adhesive reactants in the mixing nozzle is discharged concurrently with the discharge of the adhesive from the other canisters.

11. The apparatus of claim 10 wherein the discharging mechanism further includes a single pressure bar that is connected to each pair of plungers and to the actuating mechanism for concurrently displacing the pairs of plungers within pairs of segregated compartments of respective canisters upon the actuating mechanism selectively providing a driving force to the discharging mechanism, including the pressure bar.

12. The apparatus of claim 11 wherein the plurality of cradles, the discharging mechanism and the actuating mechanism are mounted on the carrier essentially in a common plane at an angle of about 30 degrees between that common plane and the substrate to which the adhesive is applied.

13. The apparatus of claim 12 including a gauge for indicating the location of the plungers in the canisters.

14. The apparatus of claim 13 wherein the motive supports include a pair of wheels located coaxially at the rearward end of the carrier, the wheels being of a width and spaced apart a distance such that, when the apparatus is used to apply adhesive to a substrate comprising a corrugated roof decking having alternating ribs and flutes, the wheels straddle a rib and rest in adjacent flutes of the decking, and two wheels located coaxially forwardly and outwardly of the pair of wheels located at the rearward end of the carrier, the two forwardly and outwardly located wheels being of a width such that, when the apparatus is used to apply adhesive to a substrate comprising a corrugated roof decking having alternating ribs and flutes, the two forwardly and outwardly located wheels rest on the ribs of the decking.

15. A method of concurrently applying to a substrate a plurality of substantially parallel strips of an adhesive comprising:

placing a canister of an adhesive in each of at least two of the cradles of the apparatus set forth in claim 7;

disposing the discharging mechanism into engagement with the canisters in the cradles in a manner adapted to discharge the adhesive from the canisters; and applying the driving force to the discharging mechanism to cause the discharging mechanism to concurrently discharge the adhesive from each of the canisters as the apparatus is transported along the path of travel over the substrate.

16. An apparatus for concurrently applying to a substrate a plurality of substantially parallel strips of an adhesive, the apparatus comprising:

a carrier having motive supports for transporting the carrier along a path of travel over the substrate;

a plurality of cradles mounted to the carrier and arranged in a line transversely of the path of travel of the carrier over the substrate, each cradle being adapted to hold a canister from which adhesive is discharged;

a discharging mechanism mounted on the carrier and adapted, when a driving force is applied, to concurrently discharge the adhesive from the plurality of canisters in the cradles;

an actuating mechanism mounted on the carrier for selectively providing the driving force to the discharging mechanism; and a force-resisting device connected to the discharging mechanism for providing a resisting force to the driving force selectively provided by the actuating mechanism to the discharging mechanism, the magnitude of the resisting force being less than the magnitude of the driving force, wherein the discharging mechanism includes at least one plunger located at each cradle that is adapted to fit within the canister of adhesive held in the cradle, each plunger being connected to the actuating mechanism for displacement within a respective canister so as to discharge the adhesive concurrently with the discharge of the adhesive from the other canisters upon the actuating mechanism selectively providing the driving force to the discharging mechanism.

17. The apparatus of claim 16 wherein the discharging mechanism further includes a single pressure bar that is connected to each plunger and to the actuating mechanism for concurrently displacing the plungers within respective canisters upon the actuating mechanism selectively providing a driving force to the discharging mechanism, including the pressure bar.

18. A method of concurrently applying to a substrate a plurality of substantially parallel strips of an adhesive comprising:

placing a canister of an adhesive in each of at least two of the cradles of the apparatus set forth in claim 16;

disposing the discharging mechanism into engagement with the canisters in the cradles in a manner adapted to discharge the adhesive from the canisters; and applying the driving force to the discharging mechanism to cause the discharging mechanism to concurrently discharge the adhesive from each of the canisters as the apparatus is transported along the path of travel over the substrate.

19. An apparatus for concurrently applying to a substrate a plurality of substantially parallel strips of an adhesive, the apparatus comprising:

a carrier having motive supports for transporting the carrier along a path of travel over the substrate;

a plurality of cradles mounted to the carrier and arranged in a line transversely of the path of travel of the carrier over the substrate, each cradle being adapted to hold a canister from which adhesive is discharged;

a discharging mechanism mounted on the carrier and adapted, when a driving force is applied, to concurrently discharge the adhesive from the plurality of canisters in the cradles;

an actuating mechanism mounted on the carrier for selectively providing the driving force to the discharging mechanism; and a force-resisting device connected to the discharging mechanism for providing a resisting force to the driving force selectively provided by the actuating mechanism to the discharging mechanism, the magnitude of the resisting force being less than the magnitude of the driving force, wherein the discharging mechanism includes a pair of plungers located at each cradle, the pairs of plungers at each cradle being adapted to fit within a complementary pair of segregated compartments that contain adhesive reactants within the canister held in the cradle and being connected to the actuating mechanism for displacement within the pair of segregated compartments in the canister upon the actuating mechanism selectively providing the driving force to the discharging mechanism, including the plungers, whereby the adhesive reactants from the pair of segregated compartments are displaced into a mixing nozzle associated with the canister from which an adhesive produced by the mixing of the two adhesive reactants in the mixing nozzle is discharged concurrently with the discharge of the adhesive from the other canisters.

20. The apparatus of claim 19 wherein the discharging mechanism further includes a single pressure bar that is connected to each pair of plungers and to the actuating mechanism for concurrently displacing the pairs of plungers within pairs of segregated compartments of respective canisters upon the actuating mechanism selectively providing a driving force to the discharging mechanism, including the pressure bar.

21. A method of concurrently applying to a substrate a plurality of substantially parallel strips of an adhesive comprising:

placing a canister of an adhesive in each of at least two of the cradles of the apparatus set forth in claim 19;

disposing the discharging mechanism into engagement with the canisters in the cradles in a manner adapted to discharge the adhesive from the canisters; and applying the driving force to the discharging mechanism to cause the discharging mechanism to concurrently discharge the adhesive from each of the canisters as the apparatus is transported along the path of travel over the substrate.

22. An apparatus for concurrently applying to a substrate a plurality of substantially parallel strips of an adhesive, the apparatus comprising:

a carrier having motive supports for transporting the carrier along a path of travel over the substrate;

a plurality of cradles mounted to the carrier and arranged in a line transversely of the path of travel of the carrier over the substrate, each cradle being adapted to hold a canister from which adhesive is discharged;

a discharging mechanism mounted on the carrier and adapted, when a driving force is applied, to concurrently discharge the adhesive from the plurality of canisters in the cradles;

an actuating mechanism mounted on the carrier for selectively providing the driving force to the discharging mechanism; and a force-resisting device connected to the discharging mechanism for providing a resisting force to the driving force selectively provided by the actuating mechanism to the discharging mechanism, the magnitude of the resisting force being less than the magnitude of the driving force, wherein the actuating mechanism includes a telescoping member having opposed ends and the driving device for developing a driving force, one of the opposed ends of the telescoping member being attached to the driving device, whereby the driving force acts to extend the telescoping member, and the other of the opposed ends of the telescoping member being attached to the discharging mechanism for transmitting to the discharging mechanism the driving force developed by the driving device.

23. The apparatus of claim 23 wherein the discharging mechanism includes at least one plunger located at each cradle that is adapted to fit within the canister of adhesive held in the cradle, each plunger being connected to the actuating mechanism for displacement within a respective canister so as to discharge the adhesive concurrently with the discharge of the adhesive from the other canisters upon the actuating mechanism selectively providing a driving force to the discharging mechanism.

24. The apparatus of claim 23 wherein the discharging mechanism further includes a single pressure bar that is connected to each plunger and to the actuating mechanism for concurrently displacing the plungers within respective canisters upon the actuating mechanism selectively providing a driving force to the discharging mechanism, including the pressure bar.

25. The apparatus of claim 22 wherein the discharging mechanism includes a pair of plungers located at each cradle, the pairs of plungers at each cradle being adapted to fit within a complementary pair of segregated compartments that contain adhesive reactants within the canister held in the cradle and being connected to the actuating mechanism for displacement within the pair of segregated compartments in the canister upon the actuating mechanism selectively providing a driving force to the discharging mechanism, including the plungers, whereby the adhesive reactants from the pair of segregated compartments are displaced into a mixing nozzle associated with the canister from which an adhesive produced by the mixing of the two adhesive reactants in the mixing nozzle is discharged concurrently with the discharge of the adhesive from the other canisters.

26. The apparatus of claim 25 wherein the discharging mechanism further includes a single pressure bar that is connected to each pair of plungers and to the actuating mechanism for concurrently displacing the pairs of plungers within pairs of segregated compartments of respective canisters upon the actuating mechanism selectively providing a driving force to the discharging mechanism, including the pressure bar.

27. A method of concurrently applying to a substrate a plurality of substantially parallel strips of an adhesive comprising:

placing a canister of an adhesive in each of at least two of the cradles of the apparatus set forth in claim 22;

disposing the discharging mechanism into engagement with the canisters in the cradles in a manner adapted to discharge the adhesive from the canisters; and applying the driving force to the discharging mechanism to cause the discharging mechanism to concurrently discharge the adhesive from each of the canisters as the apparatus is transported along the path of travel over the substrate.

28. An apparatus for concurrently applying to a substrate a plurality of substantially parallel strips of an adhesive, the apparatus comprising:

a carrier having motive supports for transporting the carrier along a path of travel over the substrate;

a plurality of cradles mounted to the carrier and arranged in a line transversely of the path of travel of the carrier over the substrate, each cradle being adapted to hold a canister from which adhesive is discharged;

a discharging mechanism mounted on the carrier and adapted, when a driving force is applied, to concurrently discharge the adhesive from the plurality of canisters in the cradles;

an actuating mechanism mounted on the carrier for selectively providing the driving force to the discharging mechanism;

a force-resisting device connected to the discharging mechanism for providing a resisting force to the driving force selectively provided by the actuating mechanism to the discharging mechanism, the magnitude of the resisting force being less than the magnitude of the driving force; and a release mechanism for releasing the driving force provided by the actuating mechanism to the discharging mechanism so as to allow the resisting force provided by the force-resisting device to disengage the discharging mechanism from the canisters.

29. The apparatus of claim 28 wherein the discharging mechanism includes at least one plunger located at each cradle that is adapted to fit within the canister of adhesive held in the cradle, each plunger being connected to the actuating mechanism for displacement within a respective canister so as to discharge the adhesive concurrently with the discharge of the adhesive from the other canisters upon the actuating mechanism selectively providing a driving force to the discharging mechanism.

30. The apparatus of claim 29 wherein the discharging mechanism further includes a single pressure bar that is connected to each plunger and to the actuating mechanism for concurrently displacing the plungers within respective canisters upon the actuating mechanism selectively providing a driving force to the discharging mechanism, including the pressure bar.

31. The apparatus of claim 28 wherein the discharging mechanism includes a pair of plungers located at each cradle, the pairs of plungers at each cradle being adapted to fit within a complementary pair of segregated compartments that contain adhesive reactants within the canister held in the cradle and being connected to the actuating mechanism for displacement within the pair of segregated compartments in the canister upon the actuating mechanism selectively providing a driving force to the discharging mechanism, including the plungers, whereby the adhesive reactants from the pair of segregated compartments are displaced into a mixing nozzle associated with the canister from which an adhesive produced by the mixing of the two adhesive reactants in the mixing nozzle is discharged concurrently with the discharge of the adhesive from the other canisters.

32. The apparatus of claim 31 wherein the discharging mechanism further includes a single pressure bar that is connected to each pair of plungers and to the actuating mechanism for concurrently displacing the pairs of plungers within pairs of segregated compartments of respective canisters upon the actuating mechanism selectively providing a driving force to the discharging mechanism, including the pressure bar.

33. The apparatus of claim 28 wherein the actuating mechanism includes a telescoping member having opposed ends and a driving device for developing a driving force, one of the opposed ends of the telescoping member being attached to the driving device, whereby the driving force acts to extend the telescoping member, and the other of the opposed ends of the telescoping member being attached to the discharging mechanism for transmitting to the discharging mechanism the driving force developed by the driving device.

34. The apparatus of claim 33 wherein the discharging mechanism includes at least one plunger located at each cradle that is adapted to fit within the canister of adhesive held in the cradle, each plunger being connected to the actuating mechanism for displacement within a respective canister so as to discharge the adhesive concurrently with the discharge of the adhesive from the other canisters upon the actuating mechanism selectively providing a driving force to the discharging mechanism.

35. The apparatus of claim 34 wherein the discharging mechanism further includes a single pressure bar that is connected to each plunger and to the actuating mechanism for concurrently displacing the plungers within respective canisters upon the actuating mechanism selectively providing a driving force to the discharging mechanism, including the pressure bar.

36. The apparatus of claim 33 wherein the discharging mechanism includes a pair of plungers located at each cradle, the pairs of plungers at each cradle being adapted to fit within a complementary pair of segregated compartments that contain adhesive reactants within the canister held in the cradle and being connected to the actuating mechanism for displacement within the pair of segregated compartments in the canister upon the actuating mechanism selectively providing a driving force to the discharging mechanism, including the plungers, whereby the adhesive reactants from the pair of segregated compartments are displaced into a mixing nozzle associated with the canister from which an adhesive produced by the mixing of the two adhesive reactants in the mixing nozzle is discharged concurrently with the discharge of the adhesive from the other canisters.

37. The apparatus of claim 36 wherein the discharging mechanism further includes a single pressure bar that is connected to each pair of plungers and to the actuating mechanism for concurrently displacing the pairs of plungers within pairs of segregated compartments of respective canisters upon the actuating mechanism selectively providing a driving force to the discharging mechanism, including the pressure bar.

38. The apparatus of claim 37 including a gauge for indicating the location of the plungers in the canisters.

39. The apparatus of claim 38 wherein the plurality of cradles, the discharging mechanism and the actuating mechanism are mounted on the carrier essentially in a common plane at an angle of about 30 degrees between that common plane and the substrate to which the adhesive is applied.

40. The apparatus of claim 37 wherein the plurality of cradles, the discharging mechanism and the actuating mechanism are mounted on the carrier essentially in a common plane at an angle of about 30 degrees between that common plane and the substrate to which the adhesive is applied.

41. A method of concurrently applying to a substrate a plurality of substantially parallel strips of an adhesive comprising:

placing a canister of an adhesive in each of at least two of the cradles of the apparatus set forth in claim 28;

disposing the discharging mechanism into engagement with the canisters in the cradles in a manner adapted to discharge the adhesive from the canisters; and applying the driving force to the discharging mechanism to cause the discharging mechanism to concurrently discharge the adhesive from each of the canisters as the apparatus is transported along the path of travel over the substrate.

42. An apparatus for concurrently applying to a substrate a plurality of substantially parallel strips of an adhesive, the apparatus comprising:

a carrier having motive supports for transporting the carrier along a path of travel over the substrate, wherein the motive supports include a pair of wheels located coaxially at the rearward end of the carrier, the wheels being of a width and spaced apart a distance such that, when the apparatus is used to apply adhesive to a substrate comprising a corrugated roof decking having alternating ribs and flutes, the wheels straddle a rib and rest in adjacent flutes of the decking, and two wheels located coaxially forwardly and outwardly of the pair of wheels located at the rearward end of the carrier, the two forwardly and outwardly located wheels being of a width such that, when the apparatus is used to apply adhesive to a substrate comprising a corrugated roof decking having alternating ribs and flutes, the two forwardly and outwardly located wheels rest on the ribs of the decking;

a plurality of cradles mounted to the carrier and arranged in a line transversely of the path of travel of the carrier over the substrate, each cradle being adapted to hold a canister from which adhesive is discharged;

a discharging mechanism mounted on the carrier and adapted, when a driving force is applied, to concurrently discharge the adhesive from the plurality of canisters in the cradles; and an actuating mechanism mounted on the carrier for selectively providing the driving force to the discharging mechanism.

43. The apparatus of claim 42 wherein:

the discharging mechanism includes a pair of plungers located at each cradle, the pairs of plungers at each cradle being adapted to fit within a complementary pair of segregated compartments that contain adhesive reactants within the canister held in the cradle and a single pressure bar connected to each pair of plungers; and the actuating mechanism includes a telescoping member having opposed ends and a driving device for developing a driving force, one of the opposed ends of the telescoping member being attached to the driving device, whereby the driving force extends the telescoping member, and the other of the opposed ends of the telescoping member being attached to the pressure bar for transmitting to the pressure bar the driving force developed by the driving device, thereby discharging the adhesive from the plurality of canisters in the cradle.

44. The apparatus of claim 43 including a force-resisting device connected to the discharging mechanism for providing a resisting force to the driving force selectively provided by the actuating mechanism to the discharging mechanism, the magnitude of the resisting force being less than the magnitude of the driving force.

45. The apparatus of claim 44 including a release mechanism for releasing the driving force provided by the actuating mechanism to the discharging mechanism so as to allow the resisting force provided by the force-resisting device to disengage the discharging mechanism from the canisters.

46. The apparatus of claim 45 including a gauge for indicating the location of the pairs of plungers in the canisters.

47. The apparatus of claim 46 wherein the plurality of cradles, the discharging mechanism and the actuating mechanism are mounted on the carrier essentially in a common plane at an angle of about 30 degrees between that common plane and the substrate to which the adhesive is applied.

48. The apparatus of claim 45 wherein the plurality of cradles, the discharging mechanism and the actuating mechanism are mounted on the carrier essentially in a common plane at an angle of about 30 degrees between that common plane and the substrate to which the adhesive is applied.

49. A method of concurrently applying to a substrate a plurality of substantially parallel strips of an adhesive comprising:

placing a canister of an adhesive in each of at least two of the cradles of the apparatus set forth in claim 42;

disposing the discharging mechanism into engagement with the canisters in the cradles in a manner adapted to discharge the adhesive from the canisters; and applying the driving force to the discharging mechanism to cause the discharging mechanism to concurrently discharge the adhesive from each of the canisters as the apparatus is transported along the path of travel over the substrate.

50. An apparatus for concurrently applying to a substrate a plurality of substantially parallel strips of an adhesive, the apparatus comprising:

a carrier having motive supports for transporting the carrier along a path of travel over the substrate;

a plurality of cradles mounted to the carrier and arranged in a line transversely of the path of travel of the carrier over the substrate, each cradle being adapted to hold a canister from which adhesive is discharged;

a gauge for indicating the location of plungers in the canisters;

a discharging mechanism mounted on the carrier and adapted, when a driving force is applied, to concurrently discharge the adhesive from the plurality of canisters in the cradles; and an actuating mechanism mounted on the carrier for selectively providing the driving force to the discharging mechanism.

51. The apparatus of claim 50 wherein the motive supports include a pair of wheels located coaxially at the rearward end of the carrier, the wheels being of a width and spaced apart a distance such that, when the apparatus is used to apply adhesive to a substrate comprising a corrugated roof decking having alternating ribs and flutes, the wheels straddle a rib and rest in adjacent flutes of the decking, and two wheels located coaxially forwardly and outwardly of the pair of wheels located at the rearward end of the carrier, the two forwardly and outwardly located wheels being of a width such that, when the apparatus is used to apply adhesive to a substrate comprising a corrugated roof decking having alternating ribs and flutes, the two forwardly and outwardly located wheels rest on the ribs of the decking.

52. A method of concurrently applying to a substrate a plurality of substantially parallel strips of an adhesive comprising:

placing a canister of an adhesive in each of at least two of the cradles of the apparatus set forth in claim 50;

disposing the discharging mechanism into engagement with the canisters in the cradles in a manner adapted to discharge the adhesive from the canisters; and applying the driving force to the discharging mechanism to cause the discharging mechanism to concurrently discharge the adhesive from each of the canisters as the apparatus is transported along the path of travel over the substrate.

53. An apparatus for concurrently applying to a substrate a plurality of substantially parallel strips of an adhesive, the apparatus comprising:

a carrier having motive supports for transporting the carrier along a path of travel over the substrate;

a plurality of cradles mounted to the carrier and arranged in a line transversely of the path of travel of the carrier over the substrate, each cradle being adapted to hold a canister from which adhesive is discharged;

a discharging mechanism mounted on the carrier and adapted, when a driving force is applied, to concurrently discharge the adhesive from the plurality of canisters in the cradles, the discharging mechanism includes a pair of plungers located at each cradle, the pairs of plungers at each cradle being adapted to fit within a complementary pair of segregated compartments that contain adhesive reactants within the canister held in the cradle and a single pressure bar connected to each pair of plungers;

a gauge for indicating the location of the pairs of plungers in the canisters; and an actuating mechanism mounted on the carrier for selectively providing a driving force to the discharging mechanism, the actuating mechanism including a telescoping member having opposed ends and a driving device for developing the driving force, one of the opposed ends of the telescoping member being attached to the driving device, whereby the driving force extends the telescoping member, and the other of the opposed ends of the telescoping member being attached to the pressure bar for transmitting to the pressure bar the driving force developed by the driving device, thereby discharging the adhesive from the plurality of canisters in the cradle.

54. A method of concurrently applying to a substrate a plurality of substantially parallel strips of an adhesive comprising:

placing a canister of an adhesive in each of at least two of the cradles of the apparatus set forth in claim 53;

disposing the discharging mechanism into engagement with the canisters in the cradles in a manner adapted to discharge the adhesive from the canisters; and applying the driving force to the discharging mechanism to cause the discharging mechanism to concurrently discharge the adhesive from each of the canisters as the apparatus is transported along the path of travel over the substrate.

55. An apparatus for concurrently applying to a substrate a plurality of substantially parallel strips of an adhesive, the apparatus comprising:

a carrier having motive supports for transporting the carrier along a path of travel over the substrate;

a plurality of cradles mounted to the carrier and arranged in a line transversely of the path of travel of the carrier over the substrate, each cradle being adapted to hold a canister from which adhesive is discharged;

a discharging mechanism mounted on the carrier and adapted, when a driving force is applied, to concurrently discharge the adhesive from the plurality of canisters in the cradles; and an actuating mechanism mounted on the carrier for selectively providing the driving force to the discharging mechanism, wherein the plurality of cradles, the discharging mechanism and the actuating mechanism are mounted on the carrier essentially in a common plane at an angle of about 30 degrees between that common plane and the substrate to which the adhesive is applied.

56. The apparatus of claim 55 including a gauge for indicating the location of the plungers in the canisters.

57. A method of concurrently applying to a substrate a plurality of substantially parallel strips of an adhesive comprising:

placing a canister of an adhesive in each of at least two of the cradles of the apparatus set forth in claim 55;

disposing the discharging mechanism into engagement with the canisters in the cradles in a manner adapted to discharge the adhesive from the canisters; and applying the driving force to the discharging mechanism to cause the discharging mechanism to concurrently discharge the adhesive from each of the canisters as the apparatus is transported along the path of travel over the substrate.

58. An apparatus for concurrently applying to a substrate a plurality of substantially parallel strips of an adhesive, the apparatus comprising:

a carrier having motive supports for transporting the carrier along a path of travel over the substrate;

a plurality of cradles mounted to the carrier and arranged in a line transversely of the path of travel of the carrier over the substrate, each cradle being adapted to hold a canister from which adhesive is discharged;

a discharging mechanism mounted on the carrier and adapted, when a driving force is applied, to concurrently discharge the adhesive from the plurality of canisters in the cradles, the discharging mechanism including a pair of plungers located at each cradle, the pairs of plungers at each cradle being adapted to fit within a complementary pair of segregated compartments that contain adhesive reactants within the canister held in the cradle and a single pressure bar connected to each pair of plungers; and an actuating mechanism mounted on the carrier for selectively providing the driving force to the discharging mechanism, the actuating mechanism including a telescoping member having opposed ends and a driving device for developing the driving force, one of the opposed ends of the telescoping member being attached to the driving device, whereby the driving force extends the telescoping member, and the other of the opposed ends of the telescoping member being attached to the pressure bar for transmitting to the pressure bar the driving force developed by the driving device, thereby discharging the adhesive from the plurality of canisters in the cradle.

59. The apparatus of claim 58 including a force-resisting device connected to the discharging mechanism for providing a resisting force to the driving force selectively provided by the actuating mechanism to the discharging mechanism, the magnitude of the resisting force being less than the magnitude of the driving force.

60. The apparatus of claim 59 including a release mechanism for releasing the driving force provided by the actuating mechanism to the discharging mechanism so as to allow the resisting force provided by the force-resisting device to disengage the discharging mechanism from the canisters.

61. The apparatus of claim 60 wherein the motive supports include a pair of wheels located coaxially at the rearward end of the carrier, the wheels being of a width and spaced apart a distance such that, when the apparatus is used to apply adhesive to a substrate comprising a corrugated roof decking having alternating ribs and flutes, the wheels straddle a rib and rest in adjacent flutes of the decking, and two wheels located coaxially forwardly and outwardly of the pair of wheels located at the rearward end of the carrier, the two forwardly and outwardly located wheels being of a width such that, when the apparatus is used to apply adhesive to a substrate comprising a corrugated roof decking having alternating ribs and flutes, the two forwardly and outwardly located wheels rest on the ribs of the decking.

62. The apparatus of claim 61 wherein the plurality of cradles, the discharging mechanism and the actuating mechanism are mounted on the carrier essentially in a common plane at an angle of about 30 degrees between that common plane and the substrate to which the adhesive is applied.

63. A method of concurrently applying to a substrate a plurality of substantially parallel strips of an adhesive comprising:

placing a canister of an adhesive in each of at least two of the cradles of the apparatus set forth in claim 58;

disposing the discharging mechanism into engagement with the canisters in the cradles in a manner adapted to discharge the adhesive from the canisters; and applying the driving force to the discharging mechanism to cause the discharging mechanism to concurrently discharge the adhesive from each of the canisters as the apparatus is transported along the path of travel over the substrate.

64. An apparatus for concurrently applying to a substrate a plurality of parallel strips of an adhesive, the apparatus comprising:

a carrier having a forward end and a rearward end and including a base and wheels rotatably mounted to the base for transporting the apparatus over the substrate along a path of travel with the forward end leading the rearward end;

a mounting structure attached to the base;

a rack of cradles attached to the mounting structure, the rack of cradles being arranged on the mounting structure in a line transversely of the path of travel of the apparatus, each of the cradles in the rack of cradles being adapted to hold a canister of the adhesive;

a pressure bar movably mounted on the mounting structure, the pressure bar being located toward the rearward end of the carrier in relation to the rack of cradles and extending substantially parallel to and located essentially in the same plane as the rack of cradles;

a plurality of plungers, each plunger having a plunger rod with opposed ends and a plunger head, one of the opposed ends of each plunger rod being secured to the pressure bar so that the plunger rod extends substantially perpendicularly from the pressure bar toward the rack of cradles, the other of the opposed ends of each plunger rod being attached to a plunger head, the plungers being of sufficient length and arranged on the pressure bar so that the plunger head of at least one plunger is positioned within each cradle in the rack of cradles for discharging an adhesive from the canisters in each cradle;

and an actuating mechanism mounted on the mounting structure for selectively forcing the pressure bar, together with the plungers, toward the rack of cradles whereby the plungers concurrently discharge adhesive from the canisters in the cradles.

65. The apparatus of claim 64 wherein the plungers are arranged on the pressure bar so that the plunger heads of two plungers are located within each cradle in the rack of cradles for discharging the adhesive from the canister in each cradle.

66. The apparatus of claim 65 wherein the rack of cradles includes two support members attached to the mounting structure parallel to one another and spaced apart a preselected distance, the support members extending across the carrier in a direction transversely of the path of travel of the apparatus;

a series of cradle-forming members extending between said support members, the cradle-forming members being positioned between the two support members substantially parallel to each other and perpendicular to the two support members and being arranged on the two support members in a plurality of pairs of cradle-forming members, the cradle-forming members, together with the sections of the support members between the pair of cradle-forming members, forming a cradle in the rack of cradles.

67. The apparatus of claim 65 wherein the actuating mechanism includes a telescoping member having opposed ends and a driving device for developing a driving force, one of the opposed ends of the telescoping member being attached to the driving device whereby the driving force developed by the driving device extends the telescoping member, and the other of the opposed ends of the telescoping member being attached to the pressure bar for transmitting to the pressure bar the driving force developed by the driving device, thereby moving the pressure bar toward the rack of cradles.

68. The apparatus of claim 67 including a force-resisting device attached to the pressure bar for providing a resisting force to the driving force applied to the pressure bar by the extension of the telescoping member by the driving device, the magnitude of the resisting force being less than the magnitude of the driving force.

69. The apparatus of claim 68 including a release mechanism for releasing the driving force of the driving device on the pressure bar to allow the force-resisting device to move the pressure bar in a direction opposite the direction of movement caused by the driving force.

70. The apparatus of claim 69 wherein a pair of wheels is located toward the rearward end of the carrier, the widths of the wheels and the spacing between the wheels being such that, when the apparatus is used to apply adhesive to a substrate comprising a corrugated roof decking having alternating ribs and flutes, the pair of wheels straddle a rib and rest in adjacent flutes of the decking, and two wheels are located coaxially toward the forward end of the carrier and outwardly of the pair of wheels toward the rearward end of the carrier, the two wheels located at the forward end of the carrier being of a width greater than the width of the flutes such that, when the apparatus is used to apply adhesive to a substrate comprising a corrugated roof decking having alternating ribs and flutes, the wheels rest on the ribs of the decking.

71. The apparatus of claim 70 including a gauge attached to the pressure bar for indicating the location of the plungers in the canisters.

72. The apparatus of claim 71 wherein the force-resisting device comprises a gas spring.

73. The apparatus of claim 64 including a force-resisting device attached to the pressure bar for providing a resisting force to the driving force applied to the pressure bar by the extension of the telescoping member by the driving device, the magnitude of the resisting force being less than the magnitude of the driving force.

74. The apparatus of claim 73 including a release mechanism for releasing the driving force of the driving device on the pressure bar to allow the compression spring to move the pressure bar in a direction opposite the direction of movement caused by the driving force.

75. The apparatus of claim 74 wherein a pair of wheels is located toward the rearward end of the carrier, the widths of the wheels and the spacing between the wheels being such that, when the apparatus is used to apply adhesive to a substrate comprising a corrugated roof decking having alternating ribs and flutes, the pair of wheels straddle a rib and rest in adjacent flutes of the decking, and two wheels are located coaxially toward the forward end of the carrier and outwardly of the pair of wheels toward the rearward end of the carrier, the two wheels located at the forward end of the carrier being of a width greater than the width of the flutes such that, when the apparatus is used to apply adhesive to a substrate comprising a corrugated roof decking having alternating ribs and flutes, the wheels rest on the ribs of the decking.

76. The apparatus of claim 75 including a gauge attached to the pressure bar for indicating the location of the plungers in the canisters.

77. The apparatus of claim 76 wherein the force-resisting device comprises a gas spring.

78. A method of concurrently applying to a substrate a plurality of substantially parallel strips of an adhesive comprising:

placing a canister of an adhesive in each of at least two of the cradles of the apparatus set forth in claim 64;

disposing the at least one plunger head positioned within each cradle into engagement with the canister in that cradle in a manner adapted to discharge the adhesive from the canister; and applying a driving force to the plungers to cause the plungers to concurrently discharge the adhesive from each of the canisters as the apparatus is transported along the path of travel over the substrate.

79. An apparatus for concurrently applying to a substrate a plurality of substantially parallel strips of an adhesive, the apparatus comprising:

a carrier having motive supports for transporting the carrier along a path of travel over the substrate;

a rack mounted on the carrier for holding one or more canisters of an adhesive;

an actuating mechanism mounted on the carrier for selectively developing a driving force; and at least one respective plunger adapted to fit within each of the one or more canisters, the at least one respective plunger being connected to the actuating mechanism for the displacement of the at least one respective plunger within each canister upon the application of the driving force from the actuating mechanism to the at least one respective plunger, whereby the adhesive from the one or more canisters is displaced from the one or more canisters to the substrate as a plurality of substantially parallel strips of the adhesive.

80. The apparatus of claim 79 including a single pressure bar connected to the at least one respective plunger and the actuating mechanism, whereby the driving force selectively developed by the actuating mechanism is applied to the pressure bar and, thereby, to the at least one respective plunger.

81. The apparatus of claim 79 wherein at least two plungers adapted to fit within each of the one or more canisters and displace from each of the one or more canisters adhesive reactants are connected to the actuating mechanism for the displacement of the at least two plungers within each of the one or more canisters whereby the adhesive reactants from each of the one or more canisters are displaced from each of the one or more canisters and mixed and the adhesive produced by the mixing of the adhesive reactants are discharged to the substrate as a plurality of substantially parallel strips of the adhesive.

82. The apparatus of claim 81 including a single pressure bar connected to the at least two plungers adapted to fit within each of the one or more canisters and the actuating mechanism whereby the driving force selectively developed by the actuating mechanism is applied to the pressure bar and, thereby, to the at least two plungers adapted to fit within each of the one or more canisters.

83. The apparatus of claim 82 wherein the actuating mechanism includes a telescoping member having opposed ends and a driving device for developing the driving force, one of the opposed ends of the telescoping member being attached to the driving device, whereby the driving device acts to extend the telescoping member, and the other of the opposed ends of the telescoping member being attached to the pressure bar for transmitting to the pressure bar the driving force.

84. The apparatus of claim 82 including a force-resisting device connected to the pressure bar for providing a resisting force to the driving force selectively provided by the actuating mechanism to the pressure bar, the magnitude of the resisting force being less than the magnitude of the driving force.

85. The apparatus of claim 84 including a release mechanism for releasing the driving force provided by the actuating mechanism to the plunger bar so as to allow the resisting force provided by the force-resisting device to disengage the at least two plungers from each of the one or more canisters.

86. The apparatus of claim 82 wherein the motive supports include a pair of wheels located coaxially at the rearward end of the carrier, the wheels being of a width and spaced apart a distance such that, when the apparatus is used to apply adhesive to a substrate comprising a corrugated roof decking have alternating ribs and flutes, the wheels straddle a rib and rest in adjacent flutes of the decking, and two wheels located coaxially forwardly and outwardly of the pair of wheels located at the rearward end of the carrier, the two forwardly and outwardly located wheels being of a width such that, when the apparatus is used to apply adhesive to a substrate comprising a corrugated roof decking having alternating ribs and flutes, the two forwardly and outwardly located wheels rest on the ribs of the decking.

87. The apparatus of claim 85 wherein the motive supports include a pair of wheels located coaxially at the rearward end of the carrier, the wheels being of a width and spaced apart a distance such that, when the apparatus is used to apply adhesive to a substrate comprising a corrugated roof decking have alternating ribs and flutes, the wheels straddle a rib and rest in adjacent flutes of the decking, and two wheels located coaxially forwardly and outwardly of the pair of wheels located at the rearward end of the carrier, the two forwardly and outwardly located wheels being of a width such that, when the apparatus is used to apply adhesive to a substrate comprising a corrugated roof decking having alternating ribs and flutes, the two forwardly and outwardly located wheels rest on the ribs of the decking.

88. A method of concurrently applying to a substrate a plurality of substantially parallel strips of an adhesive comprising:

placing one or more canisters of an adhesive in the rack of the apparatus set forth in claim 79;

disposing the at least one respective plunger adapted to fit within each canister into engagement with a respective canister in a manner adapted to discharge the adhesive from the canister; and applying the driving force to the plungers to cause the plungers to concurrently discharge the adhesive from each of the canisters as the apparatus is transported along the path of travel over the substrate.

* * * * *

UNITED STATES PATENT AND TRADEMARK OFFICE

CERTIFICATE OF CORRECTION

PATENT NO. : 7,056,556 B2
APPLICATION NO. : 10/763491
DATED : June 6, 2006
INVENTOR(S) : Robert S. Burns It is certified that error appears in the above-identified patent and that said Letters Patent is hereby corrected as shown below:

Column 14, Claim 19, Line 16: Please delete “a”, and insert therefor --the--.
Column 15, Claim 22, Line 22: Please delete “a”, and insert therefor --the--.
Column 15, Claim 23, Line 30: Please delete “claim 23”, and insert therefor --claim 22--.

Signed and Sealed this

Thirteenth Day of March, 2007

JON W. DUDAS
*Director of the United States Patent and Trademark Office*